United States Patent [19]

Steinebrunner et al.

[11] Patent Number: 4,904,025

[45] Date of Patent: Feb. 27, 1990

[54] METHOD OF AND APPARATUS FOR SUPPLYING BATCHES OF BRISTLES TO MAGAZINES OF BRUSH MAKING MACHINES

[75] Inventors: Walter Steinebrunner; Benno Dörflinger, both of Todtnau, Fed. Rep. of Germany

[73] Assignee: Anton Zahoransky, Todtnau, Fed. Rep. of Germany

[21] Appl. No.: 254,237

[22] Filed: Oct. 5, 1988

[30] Foreign Application Priority Data

Oct. 19, 1987 [DE] Fed. Rep. of Germany ..... 3735329

[51] Int. Cl.[4] ..... A46D 1/04

[52] U.S. Cl. ..... 300/7; 300/21

[58] Field of Search ..... 300/2–11, 300/21

[56] References Cited

U.S. PATENT DOCUMENTS

| | | | |
|---|---|---|---|
| 435,268 | 8/1890 | Bissell | 300/7 |
| 3,556,602 | 1/1971 | Gardner et al. | 300/7 |
| 4,111,491 | 9/1978 | Steinebrunner et al. . | |
| 4,603,913 | 8/1986 | Dorflinger et al. . | |
| 4,610,481 | 9/1986 | Steinebrunner . | |
| 4,647,113 | 3/1987 | Steinebrunner . | |

*Primary Examiner*—Mark Rosenbaum

*Attorney, Agent, or Firm*—Peter K. Kontler

[57] ABSTRACT

Supplies of loose bristles which are confined in cardboard boxes are removed stepwise in the form of batches by a vertically movable combined separating and withdrawing tool which can enter a box from above or from below and can be used to deliver successively formed batches of loose bristles to a vehicle for transport to the magazine of a brush making or other bristle processing machine or additionally serves as a vehicle for transport of successive batches to one and the same machine or to two or more discrete processing machines. A holding device is provided to prevent the partially depleted supply of bristles in a box from collapsing as a result of removal of one or more batches of bristles, and an aligning device is provided to align the bristles in the box in regions where successive batches are separated from the supply of bristles.

35 Claims, 6 Drawing Sheets

T
7e
7b
7c
7a
7d
7
6
8
B
21a
21
E
4
6
2b
2
2a
P
5'
1
5
15
23
3
12
13
20
101
9
24
100

METHOD OF AND APPARATUS FOR SUPPLYING BATCHES OF BRISTLES TO MAGAZINES OF BRUSH MAKING MACHINES

BACKGROUND OF THE INVENTION

The invention relates to the making of brushes, brooms and similar commodities in general, and more particularly to improvements in methods of and apparatus for supplying bristles to machines wherein the bristles are processed into brushes, brooms and the like. Still more particularly, the invention relates to improvements in methods of and apparatus for manipulating loose bristles, namely bristles which are not supplied in prepacked batches.

Loose bristles can be supplied by hand to a so-called transfer element which is used in a brush making or like machine to deliver tufts of brushes to an inserting tool. The latter inserts the tufts into the body of a brush. Manual delivery of loose bristles to the transfer element requires a certain amount of skill, especially during refilling of the magazine for bristles because one hand must press the remaining bristles against the rapidly moving transfer element with the exertion of a relatively large force.

It is also known to automatically tamp the bristles in the magazine of a brush making or like bristle processing machine. Reference may be had to commonly owned U.S. Pat. No. 4,111,491 granted Sept. 5, 1978 to Walter Steinebrunner et al. for "Method of and apparatus for feeding bristles in brush making machines". This patent discloses means for supplying packaged batches or bundles of bristles into the upper portion of a duct, means for removing the wrappers in a median portion of the duct, and means for tamping the thus exposed batches of bristles in the lower portion of the duct above the path of movement of the transfer element. Packaged bundles normally from cylinders wherein a batch of parallel bristles is surrounded by a plastic hose or another suitable envelope. Bristles which are supplied in the form of packaged bundles are normally used for the making of fine brushes, such as tooth brushes, hair brushes, hand washing brushes and the like. Other types of apparatus which are used to remove wrappers from bundles of packaged or prepacked bristles are disclosed in commonly owned U.S. Pat. Nos. 4,603,913 (granted Aug. 5, 1986 to Benno Dörflinger et al. for "Apparatus for storing and manipulating bundles of bristles in brush making machines"), 4,610,481 (granted Sep. 9, 1986 to Walter Steinebrunner for "Apparatus for replenishing the supplies of bristles in the magazines of brush making machines") and 4,647,113 (granted Mar. 3, 1987 to Walter Steinebrunner for "Method of replenishing the supply of bristles in the magazines of brush making machines").

Bristles which are used for the making of larger brushes and brooms which are provided with stiff and relatively large bristles are also supplied in the form of packaged bundles. This presents problems because the cost of packaging such bundles is high and, since each product requires a relatively large number of bristles, bundles must be opened and delivered to the magazine of the processing machine at frequent intervals. This has led to proposals to store larger quantities of coarse bristles in receptacles in the form of cartons or boxes. The bristles in such receptacles are already cut to proper size for use in a processing machine or are to be cut to size in the processing machine proper. Receptacles are delivered to the processing machine and their contents are transferred into the magazine of the machine by hand. This is a tedious task and such mode of transferring loose bristles into the machine is not conducive to the making of large numbers of brushes or brooms per unit of time because each such product comprises at least one handful of bristles.

OBJECTS OF THE INVENTION

An object of the invention is to provide a novel and improved method of supplying loose bristles to brush making and other bristle processing machines in such a way that the bristles need not be touched by hand and that they can be supplied to the processing machines at any selected rate.

Another object of the invention is to provide novel and improved receptacles for loose bristles.

A further object of the invention is to provide a method which renders it possible to remove batches of loose bristles from their receptacles without affecting the orientation of bristles which remain in the receptacles.

An additional object of the invention is to provide a method which renders it possible to tamp the bristles during transfer from their receptacles into the magazines of processing machines.

Still another object of the invention is to provide a method which can be used for delivery of different types of bristles to one and the same processing machine or to two or more discrete processing machines.

Another object of the invention is to provide a method which renders it possible to transfer groups of loose bristles from a receptacle for a larger quantity of loose bristles directly into the magazine of a processing machine.

A further object of the invention is to provide a novel and improved apparatus for the practice of the above outlined method.

An additional object of the invention is to provide the apparatus with novel and improved means for withdrawing batches of loose bristles from receptacles which are used for storage and transport of large quantities of parallel bristles.

Another object of the invention is to provide the apparatus with novel and improved means for preventing misalignment of bristles which remain in a receptacle upon removal of one or more batches.

A further object of the invention is to provide the apparatus with novel and improved means for repeatedly aligning the brushes in their receptacles, at least in those regions which are most likely to contain misaligned bristles.

An additional object of the invention is to provide the apparatus with novel and improved bristle withdrawing and transporting means for delivery of batches of parallel bristles directly from a source, such as a receptacle, to the magazine of a processing machine.

Another object of the invention is to provide the apparatus with novel and improved means for compacting or tamping successive withdrawn batches of loose bristles on their way toward a processing machine.

Still another object of the invention is to provide the apparatus with novel and improved means for subdividing a large supply of bristles into discrete batches in a simple and time-saving manner ad in a fully automatic way.

Another object of the invention is to provide a production line which comprises one or more bristle processing machines and one or more apparatus of the above outlined character.

An additional object of the invention is to provide an apparatus which can handle with equal facility large or small, thick or thin, short or long as well as stiff or readily flexible bristles.

A further object of the invention is to provide novel and improved receptacles for large supplies of brushes which can be used in or which can serve as component parts of the above outlined apparatus.

Another object of the invention is to provide a bristle supplying apparatus which can be used in conjunction with existing processing machines as a superior substitute for heretofore known apparatus.

SUMMARY OF THE INVENTION

One feature of the present invention resides in the provision of a method of supplying bristles to at least one bristle processing machine (for example, to one or more brush making or broom making machines). The method comprises the steps of establishing and maintaining at least one supply of loose substantially parallel bristles, mechanically separating from the supply preferably identical or nearly identical successive batches of loose bristles, and transporting the separated batches to the at least one processing machine. The separating step preferably includes withdrawing from the supply batches at a predetermined location or station, and such method further comprises the step of moving the supply of bristles following each withdrawal of a batch so as to position fresh bristles of the remaining supply at the predetermined location.

The establishing and maintaining step preferably includes confining the supply of loose bristles in a receptacle (e.g., in a cardboard box which is used for storage and shipment of loose bristles). The separating step comprises withdrawing seriatim portions of the supply from the receptacle so that the supply of bristles in the receptacle diminishes as a result of repetition of the withdrawing step, and such method preferably further comprises the step of holding the diminished supply of bristles in the receptacle against movement relative to each other and/or relative to the receptacle. The holding step preferably includes maintaining the density of the supply of bristles in the receptacle at a substantially constant value.

The method preferably further comprises the step of at least temporarily compacting or condensing the separated batches Such compacting or condensing step can precede the transporting step.

The method can further comprise the steps of establishing and maintaining at least one additional supply of loose substantially parallel bristles, mechanically separating from the additional supply successive additional batches of bristles, and transporting the separated additional batches to the at least one processing machine or another processing machine. The additional supply can contain bristles having characteristics (such as color, length, diameters, flexibility and/or others) which are different from those of bristles forming the at least one supply. Such method preferably further comprises the step of carrying out the steps of transporting batches from the at least one supply and from the additional supply in accordance with a predetermined pattern. The arrangement may be such that the step of transporting batches from the at least one supply includes transporting such batches to at least one first processing machine, and the step of transporting additional batches includes transporting additional batches to at least one second processing machine.

The separating step preferably includes repeatedly introducing a separating tool into the supply of bristles in the at least one supply to thus separate successive batches from the supply, and the method can further comprise the step of aligning the bristles in the supply, at least in the regions of introduction of the separating tool. The aligning steps can take place substantially simultaneously with the respective introducing steps.

The quantity of bristles in the at least one supply preferably equals or approximates a whole multiple of the quantity of bristles in a batch. The separating step is preferably carried out in such a way that the quantity of bristles in successively formed batches is the same or deviates only slightly from a preselected value.

In accordance with one presently preferred embodiment of the method, the separating step includes withdrawing successive batches from the at least one supply with the aforementioned separating tool, and the transporting step includes moving the separating tool with the withdrawn batch to the at least one processing machine. Alternatively, the transporting step includes conveying the batches in a vehicle, and the method then further comprises transferring successive batches from the tool into the vehicle.

Another feature of the invention resides in the provision of an apparatus for supplying bristles to at least one bristle processing machine. The apparatus comprises at least one source of supply of loose substantially parallel bristles, means for withdrawing from the supply successive batches of bristles, and means for transporting the batches to the at least one processing machine. If the at least one processing machine is designed for the making of brushes or like commodities, it can comprise a magazine for batches of bristles, an inserting tool, and means for transferring bristles from the magazine to the inserting tool. The transporting means then comprises means for admitting batches of bristles into the magazine of the brush making machine.

The withdrawing means can include at least one separating tool and means for moving the tool relative to the source so that the tool separates from the supply a series of portions each of which constitutes a batch of bristles. The tool can be provided with prongs at least one of which serves to penetrate into the supply of bristles in the source. The prongs define a compartment for reception and withdrawal of a batch of bristles at a time. The source defines a chamber having a first length, and the length of the compartment which is defined by the prongs of the tool is preferably selected in such a way that the first length is a whole multiple of the length of the compartment. This ensures that the supply of bristles in the source can be subdivided into a predetermined number of batches in such a way that no bristles or a negligible number of bristles will remain in the source upon withdrawal of $n = /W$ batches wherein n is the number of batches, L is the length of the chamber in the source and W is the length of the compartment in the separating tool. The source can include a plurality of receptacles for discrete supplies of bristles, and each receptacle can comprise built-in holding means. Such apparatus further comprises means for moving selected receptacles of the plurality of receptacles to a predetermined position relative to the withdrawing means.

The apparatus preferably further comprises means for holding the bristles of the supply in each source against movement relative to each other and relative to the respective source as a result of depletion of the respective supply by the withdrawing means. Such apparatus further comprises means for moving the holding means into and from as well as within the respective source and means for moving each source relative to the respective holding means so as to place successive portions of the supply of bristles in a source to a predetermined position relative to the separating tool or tools of the withdrawing means.

When a separating tool penetrates into the supply of bristles in a source in order to separate a batch from the supply, the tool establishes in the supply a gap between the separated batch and the remainder of the supply prior to withdrawal of the thus separated batch from the source. The apparatus can further comprise means for aligning the bristles in the source, and such aligning means can comprise at least one aligning element, means for moving the aligning element into the gap in the supply of bristles in the source, and means for moving the aligning element in the gap to thereby align the adjacent bristles with the remaining bristles. The aligning element can include one or more blades, tines, bars, strips or tongues (hereinafter called blades) which extend transversely of the bristles in the source, and the means for moving the aligning element or elements in the gap can comprise means for moving the aligning element or elements in parallelism with the bristles which are adjacent the gap. In accordance with a presently preferred embodiment of the apparatus, the aligning means comprises two blades which flank the separating tool.

The ends of each chamber are adjacent two end walls of the respective source (which can constitute an elongated receptacle), and such end walls are parallel to the bristles of the respective supply. At least one of the end walls can be provided with at least one recess for a portion of the separating tool when the latter is moved to penetrate into the receptacle. Such tool can be moved from a retracted position at one side of the receptacle to an operative position in which the tool extends into and separates a batch from the supply in the source. The holding means of such apparatus is preferably movable between a retracted position at the one side of the source to an operative position in the source. The aligning means of such apparatus is preferably movable between a retracted position at the one side of the source and an operative position in the source. The bottom wall of the receptacle which constitutes such source can be provided with an inlet for the separating tool, for the holding means and for the aligning means. The tool, the holding means and the aligning means are outwardly adjacent the bottom wall in their retracted positions. The inlet can constitute a centrally located longitudinally extending slot in the bottom wall of the receptacle.

The transporting means can include a vehicle which is movable along a predetermined path between a first position in which the vehicle can receive batches from the withdrawing means, and a second position at the processing machine, e.g., at a level above the magazine of a brush making machine.

The separating tool can be designed in such a way that its compartment has an open top, and the means for moving such separating tool can be designed to move the tool upwardly from a level beneath the source, through the source (whereby the tool separates and its compartment receives a batch from the supply in the source) and to a position above the source. Such apparatus can further comprise means for condensing or compacting the batch of bristles in the compartment while the tool is located at a level above the source. The compacting means can comprise a condensing or tamping tool which descends to enter the compartment by way of its open top and to compact the batch of bristles in the compartment, preferably before the batch is transported to the processing machine.

Instead of employing a vehicle, the transporting means can be designed to transport the separating tool and the batch in the compartment of such tool between the source and the processing machine.

The receptacles which constitute or form part of the source of bristles can be designed to confine the bristles therein during storage and/or transport. For example, each receptacle can be made of a lightweight material, such as cardboard, and can be provided with flaps or lids which are pivotable between open and closed positions to respectively expose or conceal the topmost layer of bristles therein. The receptacles are preferably elongated and their bottom walls can be provided with longitudinally extending inlets for the aforementioned separating tool, holding means and aligning means. Each inlet can constitute a longitudinally extending slot in the respective bottom wall.

The end walls of each receptacle (i.e., those walls which are parallel to the bristles of the supplies in the receptacles) can be provided with the aforementioned recesses or they can cooperate with suitable inserts to maintain the bristles out of contact with the end walls and to thus establish recesses or spaces for entry of the separating tool into the respective receptacle preparatory to separation of a batch from the supply.

If the bottom wall of a receptacle is not provided with an inlet, such bottom wall can carry one or more inserts constituting a distancing means and serving to maintain the lowermost layer of bristles above and out of contact with the bottom wall. This provides room for a portion of the separating tool when the latter enters the receptacle to separate a batch from the supply of bristles therein. The distancing means can comprise two inserts which are spaced apart from one another and each of which is adjacent one of the two sidewalls of the receptacle, i.e., those walls which extend upwardly from the bottom wall and at right angles to the longitudinal directions of the confined bristles. The bottom walls of such receptacles can be devoid of openings.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figures 1A, 1B, 1C:
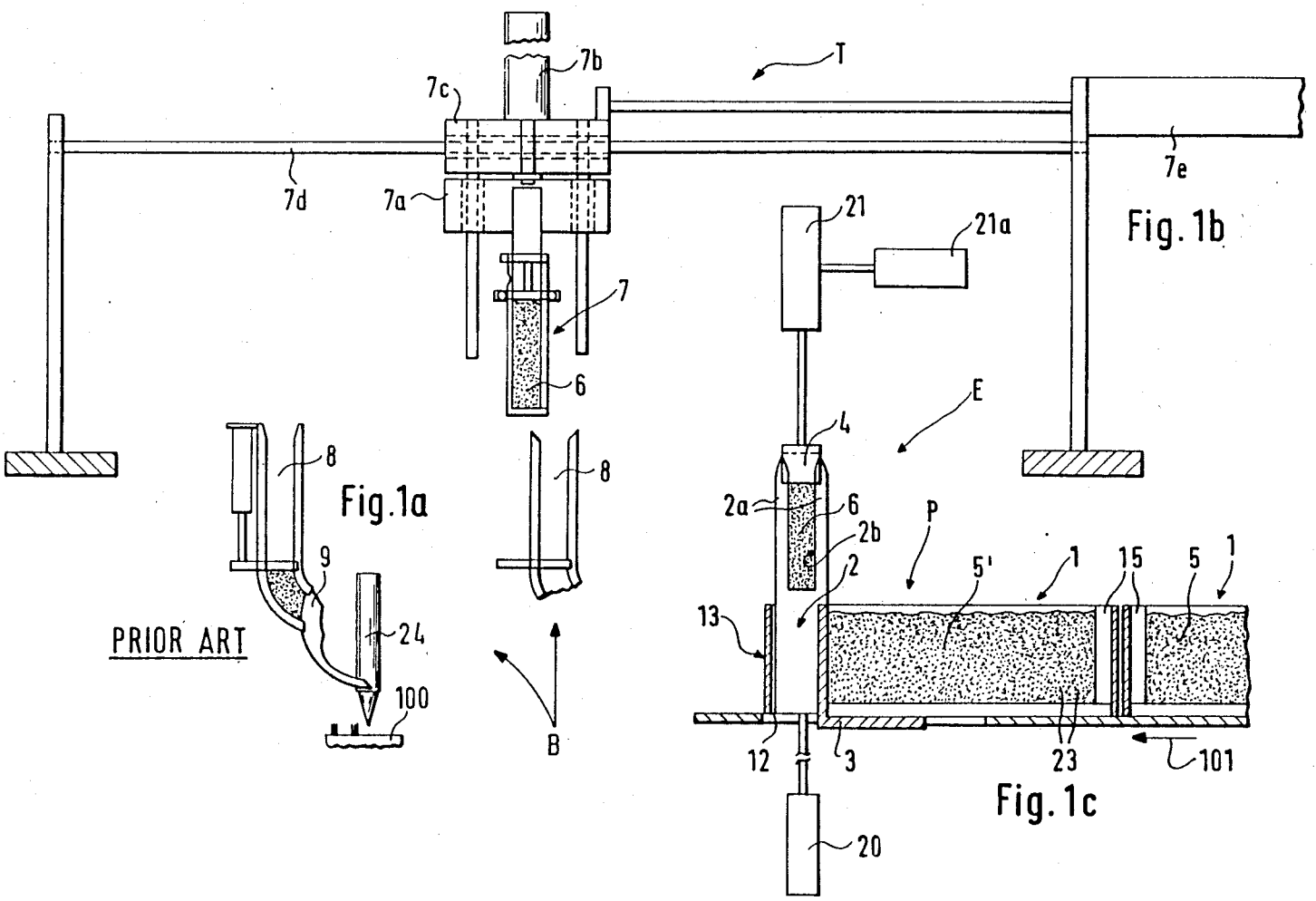
Fig. 1a PRIOR ART
FIG. 1*a* is a fragmentary elevational view of a brush making machine whose magazine can receive batches of bristles from an apparatus embodying the present invention.
FIG. 1*b* is a schematic elevational view of a transporting unit forming part of the improved apparatus and serving to transfer to the magazine batches of bristles from the locus of removal of batches from receptacles for bristles.
FIG. 1*c* is a schematic partly elevational and partly vertical sectional view of a withdrawing unit which forms part of the improved and serves to draw successive batches of bristles from receptacles and to deliver the withdrawn batches into the range of the transporting unit.

Referring first to FIG. 1*a*, there are shown portions of two conventional bristle processing machines B which can receive batches of loose bristles from apparatus embodying the present invention. Each of the machines B comprises an upright magazine 8 for a supply of loose bristles, a substantially sickle-shaped transfer element 9 which removes tufts of bristles from the open lower end of the respective magazine 8, and a tuft inserting tool 24 which introduces portions of successively delivered tufts into the body 100 of a brush. The machines B can be of the type described and shown in the aforementioned U.S. Pat. No. 4,111,491 to Steinebrunner et al. The disclosure of this patent is incorporated herein by reference.

One form of the apparatus which can be used for supplying batches 6 of loose (i.e., unpackaged) bristles 23 from one or more sources 1 into the magazines 8 of the machines B is shown in FIGS. 1*b* and 1*c*. This apparatus comprises essentially a first (withdrawing) unit E which serves to withdraw successive batches 6 of bristles 23 from successive sources 1 in the form of elongated receptacles, and a second (transporting) unit T which transports successive batches 6 from the withdrawing unit E to the magazine 8 of a selected processing machine B. One of the receptacles 1 which can be used in or with the apparatus of FIGS. 1*b* and 1*c* is shown in greater detail in FIGS. 2 to 6 and 7*a*, 7*b*. This receptacle comprises an elongated bottom wall 19 having a centrally located elongated inlet 12 in the form of a relatively narrow slot extending all the way between a front end wall 13 and a rear end wall 14. The receptacle 1 further comprises two sidewalls 17, 18 which alternate with the end walls 13, 14 and extend in parallelism with the inlet 12. A full supply 5 of bristles 23 in the receptacle 1 fills the latter to a predetermined level, and the bristles are generally or exactly parallel to each other and extend in parallelism with the end walls 13, 14, i.e., at right angles to the planes of the sidewalls 17, 18. The lowermost layer of bristles 23 which form a full supply 5 extends across the respective inlet 12. At least one of the end walls 13, 14 is provided with a vertically extending recess 15 which is open at its upper and lower ends and communicates with the respective end of the inlet 12. It is preferred to provide a recess 15 in each of the end walls 13, 14 because this renders it possible to put the receptacle 1 to use in the orientation which is shown in FIGS. 1*c* and 2 to 6 or after the receptacle is turned on a horizontal support through 180 degrees so that the end wall 13 trades places with the end wall 14. A receptacle 1 which contains a full (intact) supply 5 of bristles 23 is advanced stepwise in the direction of arrow 101 (FIG. 1*c*) by a suitable prime mover (such as one of the motors 201 shown in FIG. 11) in such a way that successive portions of the supply 5 are moved to a predetermined location at a withdrawing station P (FIG. 1*c*) where such portions of the supply can be removed by a separating tool 2 resembling a fork and having two upwardly extending portions or prongs 2*a* flanking a narrow upright compartment 2*b* which is open at the top and serves to receive a batch 6 of loose bristles 23 in response to upward movement of the tool 2 from the retracted position of FIGS. 2 and 3 (beneath the receptacle 1 at the withdrawing station P) to the position of FIG. 4 in which the prongs 2*a* are located in the interior of the receptacle 1 and the right-hand prong 2*a* has separated a batch 6 from the supply 5 so as to establish a gap G between the remainder 5' of the supply 5 and the freshly separated batch 6, and thereupon to the position of FIG. 1*c*, 5 or 6 in which the separated batch 6 is located at a level above the receptacle 1 and is ready to be taken over by a reciprocable vehicle 7 of the transporting unit T. The tool 2 can enter the receptacle 1 at the station P from below by way of the slot-shaped inlet 12 in the bottom wall 19. During initial penetration into the interior of a filled receptacle 1, the left-hand prong 2*a* of the tool 2 enters the recess 15 of the front end wall 13 whereas the right-hand prong 2*b* penetrates into and through the full supply 5 to convert the latter into a partial supply (remainder) 5' and a batch 6 with a gap G between the partial supply and the batch. The width of the gap G equals or approximates the corresponding dimension of the right-hand prong 2*a* (as measured in the longitudinal direction of the inlet 12 and receptacle 1 at the station P).

A vertically and horizontally movable batch compacting, condensing or tamping device 4 is provided at a level above the withdrawing station P and serves to cooperate with the tool 2 (in the position of FIG. 1*c*, 5 or 6) to condense the batch 6 in the compartment 2*b* of the lifted tool 2 and to thus promote accurate alignment of bristles 23 which form the removed batch 6 as well as to enable the tool 2 to properly retain and raise batches 6 consisting of bristles 23 which are or can be much longer than the width of the compartment 2*b* (as measured at right angles to the plane of FIG. 1*c* or FIGS. 2–6). Thus, when the compacting device 4 enters the compartment 2*b* by way of the open top of this compartment, either as a result of upward movement of the tool 2 or as a result of downward movement of the device 4 while the tool 2 moves upwardly, the batch 6 in the compartment 2*b* is gripped and condensed between the surface at the bottom of the compartment and the underside of the device 4. The compacting device 4 thereupon preferably shares the movement of the tool 2 to a position in which the compacted batch 6 is transferred from the compartment 2*b* into the vehicle 7 preparatory to transport to the magazine 8 of the selected processing machine B.

The means for moving the tool 2 up and down comprises a motor 20 (e.g., a fluid-operated double-acting cylinder and piston unit) which is installed in the frame of the apparatus at a level below the withdrawing station P, and the means for moving the compacting device 4 horizontally and vertically comprises two motors 21 and 21*a*. The motor 21*a* is mounted in the frame at a level above the withdrawing station P and can move the compacting device 4 and the motor 21 along a horizontal path. The motor 21 moves the device 4 down and up, i.e., toward, into and out of the open top of the compartment 2*b* because the prongs 2*a* of the separating tool 2.

The apparatus further comprises a holding or retaining device 3 which serves to prevent the partial supply 5' of bristles 23 in a partially evacuated receptacle 1 from collapsing and from thus adversely influencing the quantities of bristles 23 in subsequently removed batches 6. The holding device 3 is constructed and operated in such a way that it maintains the density and other desirable characteristics of the partial supply 5' constant or unchanged in spite of repeated removal of batches 6 from the respective receptacle 1. The holding device ensures that the height of the partial supply 5' of bristles 23 in a receptacle 1 matches that of the full supply 5. This contributes to uniformity of batches 6 which are removed from the receptacle 1 at the withdrawing station P. The length L (FIG. 2) of the chamber 1A in each receptacle 1 is a whole multiple of the length W of the compartment 2*b* (as measured in the longitudinal direction of the inlet 12). This ensures that the number of bristles 23 in the last batch 6 which is removed or lifted out of a receptacle 1 matches or closely approximates the number of bristles in each previously separated and withdrawn batch 6. The length of steps which are carried out by a receptacle 1 at the withdrawing station P in the direction of arrow 101 matches or closely approximates the length W of the compartment 2*b*.

Figure 13A:
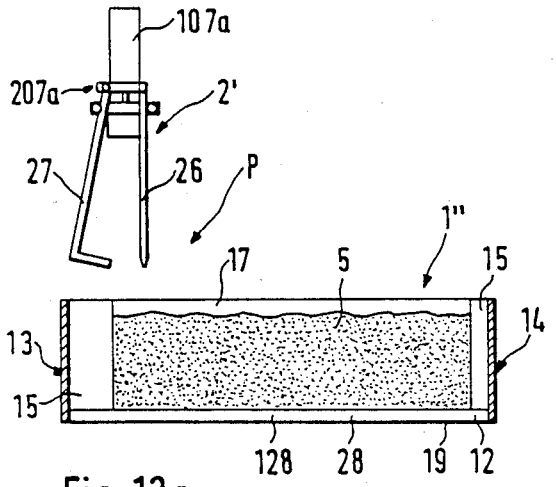
FIG. 13*a*is a central longitudinal vertical sectional view of a receptacle similar to that shown in FIGS. 7*a* and 7*b*, and further showing a modified combined batch forming and separating device which further constitutes an element of the transporting unit, the device being shown in its inoperative position at a level above the receptacle.
Figure 13B:
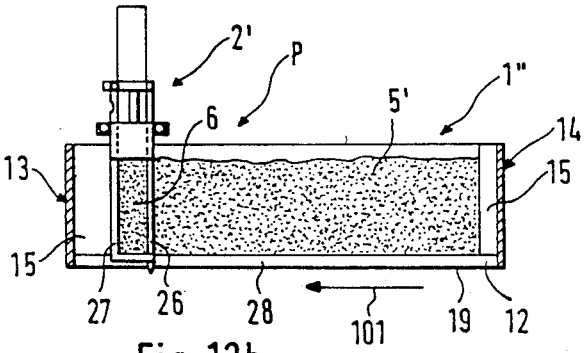
FIG. 13*b* shows the structure of FIG. 13*a*, with the device in the process of separating a batch of bristles from the supply of bristles in the receptacle.

The vehicle 7 of the transporting unit T is or can be identical with a modified separating tool 2' which is shown in FIGS. 13*a* and 13*b*. This vehicle is mounted on a carriage 7*a* which is movable down and up by a motor 7*b* so that it can descend into a selected magazine 8 or sufficiently close to the separating tool 2 in order to receive a compacted batch 6 (upon extraction of the compacting device 4 from the open top of the compartment 2*b*). The carriage 7*a* is movable up and down relative to a second carriage 7*c* which supports the motor 7*b* and is mounted for movement along elongated guide rails 7*d* so that the vehicle 7 can move between a selected magazine 8 and a position above the withdrawing station P. The means for moving the carriage 7*c* along the guide rails 7*d* comprises a motor 7*e* (e.g., a double-acting fluid-operated cylinder and piston assembly). The carriage 7*a* further supports suitable means (e.g., electromagnets) for opening and closing the vehicle 7 so that the latter can accept a batch 6 from the separating tool 2 and can admit the thus accepted batch into a selected magazine 8.

The manner in which the tool 2 separates and removes the first or foremost batch 6 of a total of, for example, ten successive batches from one and the same receptacle 1 (it is assumed here that L = 10W) is shown in FIGS. 2 to 6. Prior to start of a working stroke of the tool 2 under the action of the moving means 20, the tool 2 and the holding device 3 are maintained at a level beneath and adjacent the underside of a fresh (filled) receptacle 1. The receptacle has been moved by its motor 201 (either directly or through the medium of one or more next-following filled receptacles 1) to the position of FIG. 2 in which the foremost (leftmost) portion of the full supply 5 in located directly above the open top of the compartment 2*b*.

Figure 3:
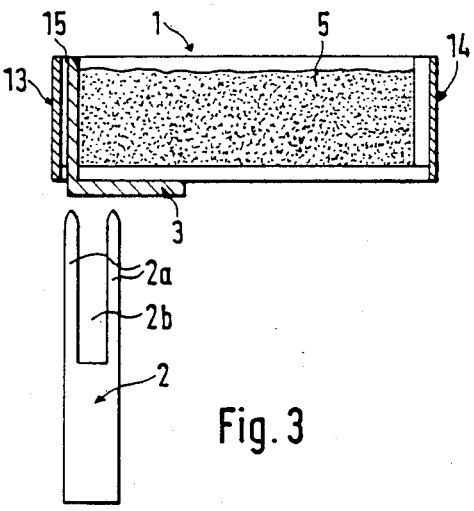
FIG. 3 shows the structure of FIG. 2, with the retaining device in operative position.

The holding device 3 is then lifted by its moving means (shown in FIGS. 8 and 9) to the position of FIG. 3 in which its vertical holding or retaining member 3*a* (including two strips, rods, bars or blades, see FIG. 9) extends into the recess 15 of the front end wall 13 and abuts the leftmost bristles 23 of the full supply 5. The means for moving the device 3 urges the vertical member 3*a* in a direction to the right so that the member 3*a* bears against the adjacent bristles 23. The motor 20 then lifts the tool 2 so that the left-hand prong 2*a* enters the recess 15 of the front end wall 13 between the halves of the member 3*a* of the holding device 3 (see particularly FIG. 9) and the right-hand prong 2*a* penetrates into the supply 5 to form the aforementioned gap G and to thus divide the supply 5 into a batch 6 (in the compartment 2*b*) and a partial supply 5'. This is shown in FIG. 4.

Figure 4:
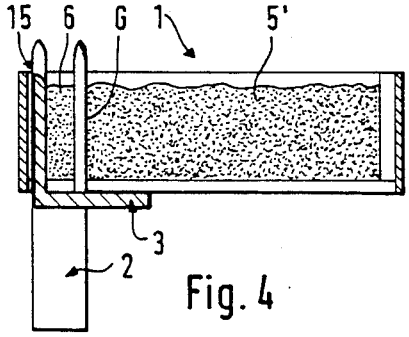
FIG. 4 shows the structure of FIG. 3, with the batch forming and separating device in a position subsequent to separation of a batch from the full supply of bristles in the receptacle.
Figure 5:
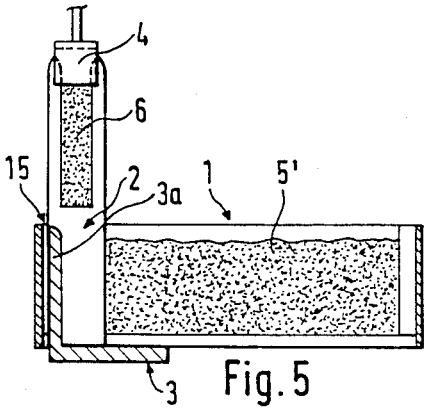
FIG. 5 shows the structure of FIG. 4, with the batch forming and separating device on its way toward the transporting unit.

The holding device 3 then remains in the position of FIGS. 3 and 4 while the motor 20 continues to raise the separating tool 2 and the batch 6 in the compartment 2*b* toward the compacting device 4 (see FIG. 5). The device 4 enters the open top of the compartment 2*b* and cooperates with the bottom wall in the compartment to condense or tamp the bristles 23 of the lifted foremost batch 6 so that the bristles are aligned (if necessary) and cannot escape from the compartment 2*b* during movement of the tool 2 toward a position of readiness to have the compacted batch 6 taken over by the vehicle 7 for transport toward and into the magazine 8 of one of the machines B shown in FIG. 1*a*.

Figure 2:
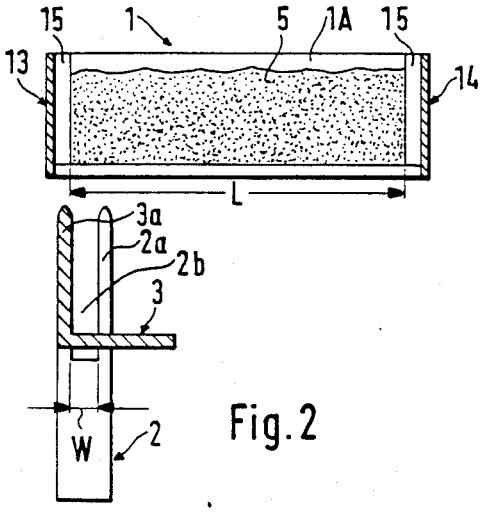
FIG. 2 shows a portion of the structure of FIG. 1*c*, with a batch forming and separating device and a bristle retaining device in their starting positions.
Figure 6:
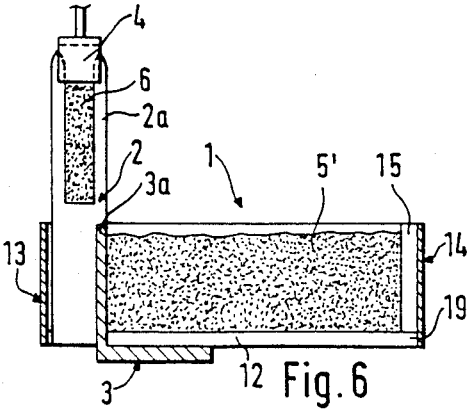
FIG. 6 shows the structure of FIG. 5 and a condensing device for the batch of bristles which are carried by the batch forming and separating device.
Figure 7A:
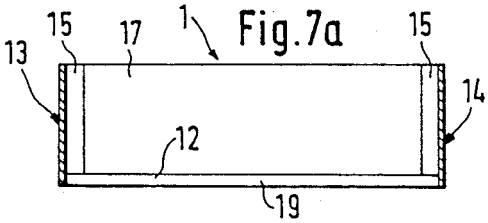
FIG. 7*a* is a central longitudinal vertical sectional view of an empty receptacle of the type shown in FIGS. 1*c* and 2 to 6.
Figure 7B:
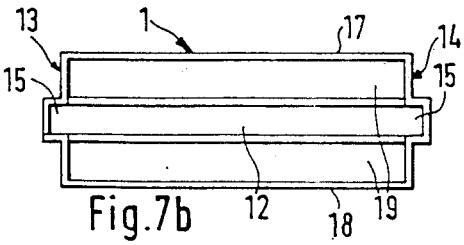
FIG. 7*b* is a top plan view of the receptacle which is shown in FIG. 7*a;*

Once the compartment 2*b* is lifted to a level above the partial supply 5′ in the receptacle 1, the holding device 3 is moved from the position of FIG. 5 the position of FIG. 6 (its member 3*a* can bypass the tool 2 but not a batch 6 in the compartment 2*b*) so that the member 3*a* then bears against the leftmost bristles 23 of the partial supply 5′ and ensures that the bristles of this partial supply cannot move relative to each other and/or relative to the receptacle 1, even when the tool 2 is retracted back to the position of FIGS. 2 and 3, i.e., to a level beneath the bottom wall 19.

The motor 20 thereupon lowers the tool 2 (as soon as the transfer of the compacted batch 6 from the compartment 2*b* into the vehicle 7 is completed), and the motor 201 then advances the receptacle 1 by a step in the direction of arrow 101 so as to place the leftmost portion of the partial supply 5′ into register with the open top of the compartment 2*b*. The holding device 3 shares such leftward movement of the receptacle 1, i.e., it remains in contact with the leftmost bristles 23 of the partial supply 5′. The operation is then repeated, i.e., the motor 20 raises the tool 2 to remove a second batch 6 which is compacted by the device 4 and accepted by the vehicle 7, the member 3*a* of the holding device 3 moves to the right to engage the leftmost bristles 23 of the remaining partial supply 5′ as soon as the second batch 6 is lifted above the partial supply 5′, the motor 20 returns the tool 2 to the retracted position of FIG. 2, the motor 201 advances the receptacle and the holding device 3 by a step in the direction of arrow 101, and so on until the supply of bristles 23 in the receptacle 1 is exhausted. The empty receptacle 1 is replaced by the next-following receptacle (see FIG. 1*c*).

The level of the supply of bristles in each of the magazines 8 is monitored in a customary way, and the output elements of the monitoring means (such as photoelectronic detectors) transmit signals which initiate movements of the holding device 3, tool 2, receptacle 1 at the station P, compacting device 4 and vehicle 7 in order to replenish the supply of bristles 23 in that magazine 8 wherein the supply has been depleted below a minimum acceptable value.

The depth of the recesses 15 in the front and rear end walls 13, 14 of a receptacle 1 need not exceed, or need not appreciably exceed, the corresponding dimensions of the vertical member 3*a* of the holding device 3 and of the left-hand prong 2*a* of the separating tool 2.

Figure 9:
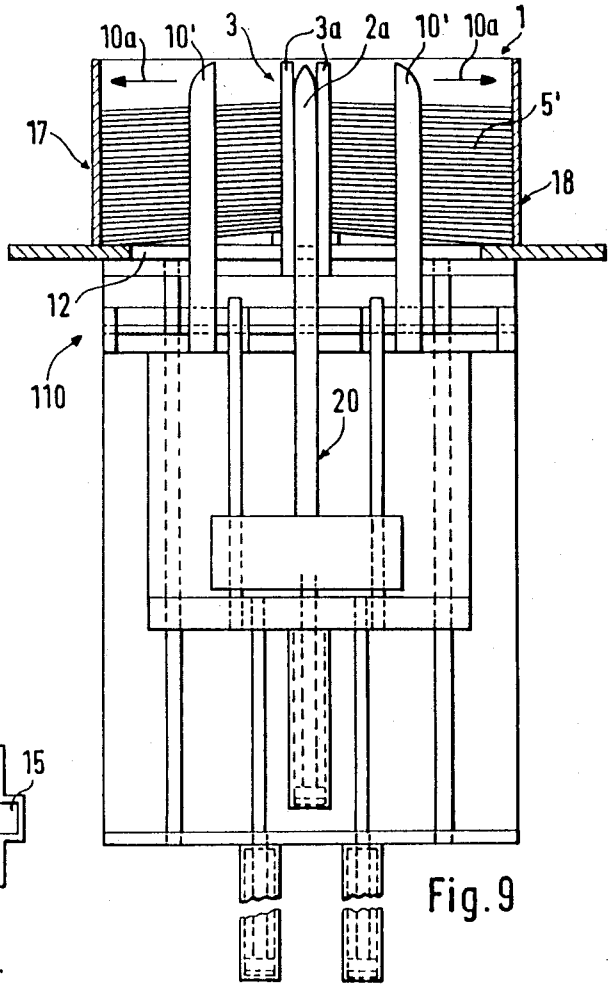
FIG. 9 is a front elevational view as seen from the left-hand side of FIG. 8, the batch forming and separating device and the retaining device being shown in the positions of FIG. 4 and the aligning device being shown in raised position prior to movement of its components toward the respective sidewalls of the receptacle.
Figure 8:
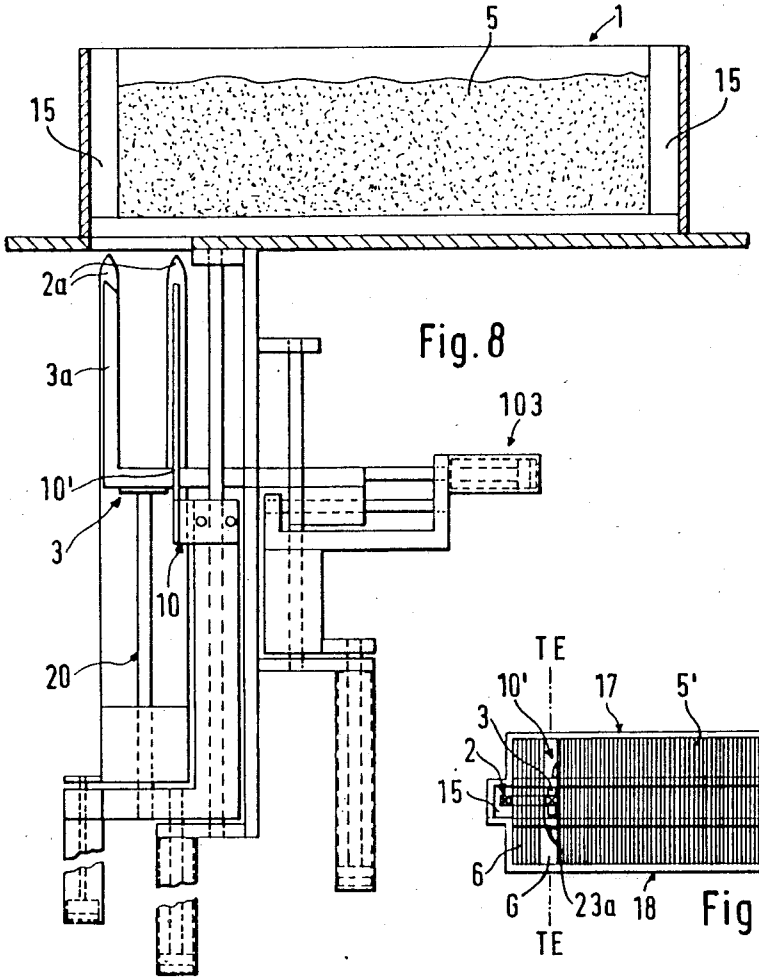
FIG. 8 is an enlarged view of the structure which is shown in FIG. 2 and further illustrates an aligning device for bristles in the interior of a receptacle as well as the means for moving the batch forming and separating device, the retaining device and the aligning device.

FIGS. 8 and 9 show the means 20 for moving the separating tool 2 up and down from and back to the retracted position of FIGS. 2 and 3, the means 103 for moving the holding device 3 with and relative to the receptacle 1 at the withdrawing station P, and the means 110 for moving an aligning device 10 which serves to align the bristles 23 in the regions of successively formed gaps G, i.e., in the general plane TE of the right-hand prong 2*a* of the separating tool 2. The means 103 for moving the holding device 3 preferably comprises a set of fluid-operated motors which cooperate to move the bifurcated member 3*a* of the holding device into the recess 15 of the front end wall 13 forming part of a filled receptacle 1, to thereupon move the member 3*a* to the right (from the position of FIG. 5 to the position of FIG. 6), and to enable the member 3*a* to share the movements of the receptacle 1 in the direction of the arrow 101.

Figure 10:
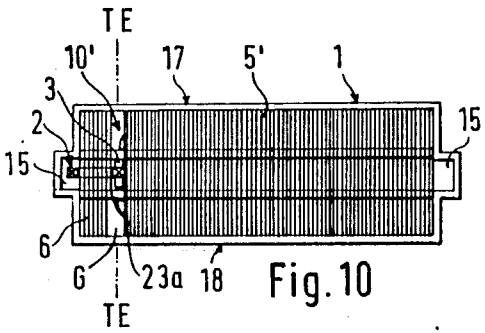
FIG. 10 is a smaller-scale plan view of the receptacle and of the three devices which are shown in FIG. 9.

In FIG. 8, the separating tool 2 and the holding device 3 are maintained in positions corresponding substantially to those which are shown in FIG. 2, i.e., the tool 2 and the device 3 are maintained at the same side of the receptacle 1 at the withdrawing station P (beneath the bottom wall 19). This also applies for the blades 10′ of the bifurcated aligning device 10 which is movable up and down by a mechanism 110. The latter can lift the aligning device 10 so that the blades 10′ penetrate into the gap G between a freshly separated batch 6 and the partial supply 5′ (see FIG. 10) and that the blades 10′ thereupon move away from each other longitudinally of the adjacent bristles 23 in order to ensure that such bristles are aligned with the remaining bristles of the separated batch 6 and the partial supply 5′. The directions in which the blades 10′ are movable away from each other are indicated by arrows 10*a* (see FIG. 9), i.e., these blades then move toward the respective sidewalls 17, 18. A misaligned bristle is shown in FIG. 10, as at 23*a*.

The aligning device 10 constitutes an optional but desirable feature of the improved apparatus. It is practically unavoidable that at least some of the filled receptacles 1 will contain a few misaligned bristles 23*a* and/or that some misalignment of bristles will occur in response to penetration of the right-hand prong 2*a* of the separating tool 2 into the full supply 5 or into the partial supply 5′ of bristles 23 in the receptacle 1 at the withdrawing station P. This is due to the fact that the bristles 23 in the receptacles 1 are not gathered into packaged bundles as is customary with finer or thinner bristles which are used for the making of tooth brushes, hair brushes and the like.

The operation of the aligning device 10 is as follows:

When the prongs 2*a* of the separating tool 2 penetrate into the receptacle 1 at the withdrawing station P by way of the inlet 12 in the bottom wall 19 of such receptacle, the right-hand prong 2*a* forms a gap G between the freshly separated batch 6 and the partial supply 5′. The mechanism 110 then causes the blades 10′ of the aligning device 10 to penetrate into the gap G from below (i.e., by way of the inlet 12) in such positions that they are remote from the respective sidewalls 17 and 18. In the next step, the mechanism 110 causes the blades 10′ to move in the directions which are indicated by the arrows 10*a* so that the blades slide along the adjacent bristles 23 of the batch 6 and partial supply 5′ and bring about at least some alignment of eventually misaligned bristles 23*a* to thus enhance the quality of batches 6 which are removed by the separating tool 2 for admission into the vehicle 7 of the transporting unit T prior to introduction into the magazine 8 of a selected processing machine B. The blades 10′ flank the blades or halves of the vertical member 3*a* of the holding device 3 so that the blades 10′ cannot interfere with movements of the member 3 into or out of the receptacle 1 at the withdrawing station P and/or with movements of the holding device 3 in the direction of arrow 101. The blades 10′ are retracted to the positions of FIG. 8 before the motor 201 is set in motion to advance the receptacle 1 in the direction of arrow 101.

FIGS. 9 and 10 show the blades 10′ of the aligning device 10 in inserted positions, i.e., the blades 10′ extend into the gap G between the separated batch 6 and the partial supply 5′ but are yet to move in directions which are indicated by the arrows 10*a*, namely toward the adjacent sidewalls 17 and 18. In their starting positions (prior to movement in the directions of arrows 10*a*) the blades 10′ can be immediately or closely adjacent the respective halves of the vertical member 3*a* of the holding device 3.

An important advantage of the improved apparatus is that it can break up the contents of successively delivered filled receptacles 1 in a fully automatic way and can transfer to the magazines 8 of selected processing machines B identical or practically identical batches 6 of properly aligned bristles 23 at short intervals because the vehicle 7 need not be filled and/or its contents evacuated by hand. This brings about savings in manpower and renders it possible to further automate the operation of the processing machines B as well as to ensure the delivery of predictable quantities of bristles 23 in optimum formations for processing into brushes, brooms and/or other bristle-containing products.

The holding device 3 contributes significantly to the formation of identical or practically identical batches 6 in spite of progressive depletion of the supply of bristles 23 in the receptacle 1 at the withdrawing station P. In the absence of the holding device 3, the bristles 23 which constitute the partial supply 5' would spread out along the bottom wall 19 of the respective receptacle 1 all the way to the front end wall 13 upon each extraction of the separating tool 2 so that the height of the partial supply 5' would decrease and the compartment **2*b* would be only partially filled with bristles upon completion of the next upward stroke of the tool 2**.

The compacting device 4 also contributes to uniformity of batches 6 which are admitted into the vehicle 7. This is due to the fact that the device 4 condenses the batch 6 in the compartment **2*b* not later than immediately prior to transfer of the batch into the vehicle 7 so that the bristles 23 which form the batch 6 are aligned again before the batch 6 begins to advance along the guide rails 7*d* on its way toward the magazine 8 of a selected processing machine B. Moreover, and as already mentioned above, the compacting device 4 renders it possible to employ a relatively small separating tool 2 whose bulk, weight and inertia are small because it can cooperate with the compacting device 4 to properly hold and move a batch 6 in the compartment 2*b* even though the thickness of its prongs 2*a* is a very small or minute fraction of the distance between the sidewalls 17 and 18, i.e., of the length of a bristle 23 (see FIG. 9). The separating tool 2 is preferably positioned exactly or substantially midway between the sidewalls 17, 18 of the receptacle 1** at the withdrawing station P.

The receptacles 1 can be made of a lightweight material, such as cardboard, and preferably also serve for storage and transport of full supplies 5 of bristles 23. This renders it even more desirable to employ the aligning device 10 and the compacting device 4 because some of the loose bristles 23 in the interior of a receptacle 1 are likely to become misaligned during transport of receptacles 1 from the maker of bristles to the withdrawing station P. Moreover, at least partial alignment of bristles 23 in the receptacle 1 at the station P, at least in the plane TE of each gap G, renders it possible to employ a very simple, compact and lightweight separating tool without affecting the quality of batches 6 in the compartment **2*b* and/or in the vehicle 7. The blades 10' of the aligning device 10 can be said to constitute a means for invariably separating the bristles of a batch 6 in the compartment 2*b* from the adjacent bristles of the partial supply 5' in the receptacle 1 at the station P before the tool 2 proceeds to lift the freshly separated batch 6 to a position above the level of the partial supply 5'. This greatly reduces the likelihood of misalignment of bristles 23 in the leftmost portion of the partial supply 5' (adjacent the gap G) as a result of upward movement of the adjacent bristles 23 of the batch 6 in the compartment 2*b* while the tool 2 moves from the position of FIG. 4 toward the position of FIG. 5. Furthermore, the aligning device 10 ensures that the quality of the first batch 6 which is removed from a receptacle 1 at the withdrawing station P is just as satisfactory as the quality of any next-following (as well as the last) batch because the bristles 23 of each freshly formed batch 6 are invariably separated from the adjacent portion of the partial supply 5' before the freshly formed batch is caused to rise with the compartment 2*b* on its way toward engagement by the compacting device 4**.

The feature that the length L of the chamber 1A in a receptacle 1 equals nW (wherein n is a whole number exceeding one) ensures that the supply 5 in each receptacle is fully exhausted before the receptacle is removed from the withdrawing station P. This contributes to a more economical operation of the apparatus by bringing about savings in bristles as well as on the additional ground that it is not necessary to manually or otherwise remove the remnants of supplies 5 before the receptacles 1 are discarded or returned to the filling plant or station.

The recesses 15 in the end walls 13 and 14 of the receptacles 1 are optional but desirable and advantageous. They reduce the likelihood of misalignment of bristles 23 in the foremost portion of a full supply 5 during initial penetration of the prongs **2*a* into a filled receptacle 1. The same holds true for introduction of the vertical member 3*a* of the holding device 3 into a freshly delivered receptacle 1 which contains a full supply 5 of bristles 23, i.e., the member 3*a* can move upwardly to enter the recess 15 in the front end wall 13 without even touching the adjacent bristles 23 of the full supply 5. The recess 15 in the rear end wall 14 simplifies the removal of the last batch 6 from a receptacle 1 at the station P because the right-hand prong 2*a* of the tool 2 can enter such recess and is thus less likely to alter the positions of adjacent bristles 23 in the last batch 6 while moving from the position of FIG. 3 to the position of FIG. 4**.

While it is equally within the purview of the invention to assemble the apparatus in such a way that, when in their retracted positions, the inserting tool 2, the holding device 3 and the aligning device 10 are outwardly adjacent one sidewall (17 or 18) of the receptacle 1 at the withdrawing station P, the arrangement which is shown in FIGS. **1*b* to 10 is preferred at this time because the apparatus takes up less floor space and because it is simpler to move fresly separated batches 6 in a direction at right angles to the bristles 23 of such batches. Moreover, the apparatus can use or cooperate with relatively simple and inexpensive receptacles each of which merely exhibits a single inlet 12 in its bottom wall 19**.

The bottom wall 19 of each receptacle 1 can be formed with two or more inlets, for example, a centrally located inlet for the separating tool 2 and an additional inlet for each of the holding and aligning devices 3 and 10. The provision of a single inlet 12 is preferred because this does not unduly weaken the bottom wall 19 and contributes to lower cost of the receptacles.

Figure 11:
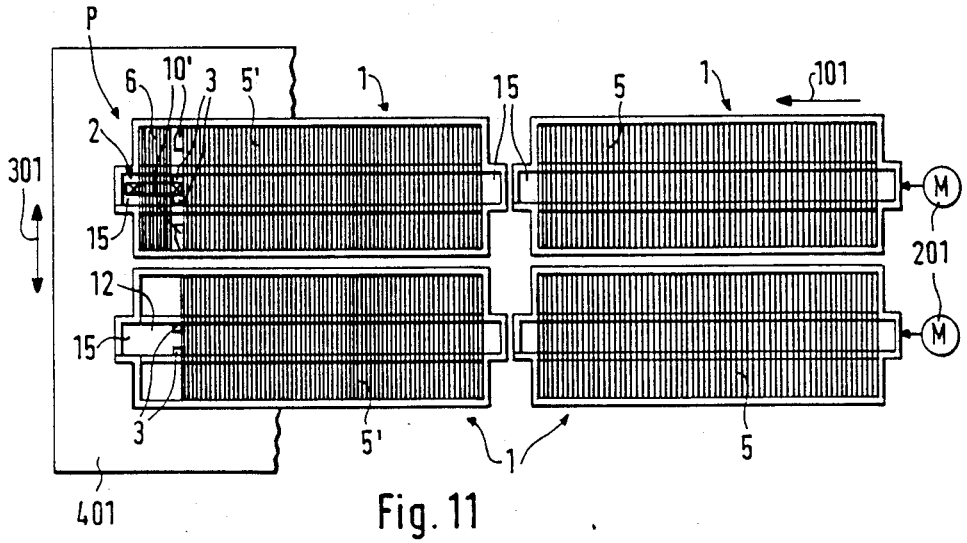
FIG. 11 is a plan view of an array of four discrete receptacles which are assumed to contain different types of bristles.

FIG. 11 shows several receptacles 1 which are provided with built-in holding devices 3 each of which can be identical with or similar to the holding device 3 shown in FIGS. **1*c*, 2 to 6 and 8 to 10. The separating tool 2 is in the process of removing a first batch 6 from the full supply of bristles in the receptacle 1** in the upper left-hand corner of FIG. 11, and the receptacle 1 which is shown in the lower left-hand portion of FIG. 11 contains a partial supply 5' of bristles. The two upper receptacles 1 of FIG. 11 contain bristles of a first type (e.g., bristles of a first color, diameter or stiffness) and the two lower receptacles 1 of FIG. 11 contain bristles of a second type, e.g., bristles of a different color. The tool 2 is movable sideways (i.e., up and down as seen in FIG. 11) and/or the receptacles 1 and their motors 201 are movable sideways so that a single tool 2 will suffice to remove batches 6 from the foremost (leftmost) receptacle 1 of the upper row or from the foremost receptacle 1 of the lower row of FIG. 11. The motors 201 serve to advance the respective rows of receptacles 1 in the direction which is indicated by the arrow 101.

The built-in holding device 3 in the lower left-hand receptacle 1 of FIG. 11 maintains the partial supply 5' of bristles in an optimum condition for removal of predictable batches 6.

Apparatus embodying the structure of FIG. 11 can be used with particular advantage for the making of brushes or other bristle-containing products which employ sets of differently colored bristles, e.g., wherein tufts of bristles of one color alternate or are in any other distribution with tufts of bristles of at least one other color. The apparatus can use or cooperate with three or more rows of receptacles 1 for differently colored bristles, and such apparatus can employ two or more separating tools 2 all of which preferably deliver batches 6 to one and the same transporting unit.

The purpose of built-in holding devices 3 is to enable the receptacles 1 which are shown in FIG. 1 to move to and from a single withdrawing station P (note the arrow 301) as well as to move stepwise in the direction of arrow 101. For example, the receptacles 1 of FIG. 11 and their motors 201 can be mounted on a platform 401 which is movable in directions indicated by the arrow 301 so that a single separating tool 2 suffices to remove batches 6 from either of the two leftmost receptacles 1.

In addition to or in lieu of containing differently colored bristles, the two rows of receptacles 1 which are shown in FIG. 11 can contain bristles of different softness or flexibility so that brushes or brooms which are formed in the machines receiving bristles from the apparatus embodying the structure of FIG. 11 can contain tufts of softer and tufts of harder bristles.

Figure 12:
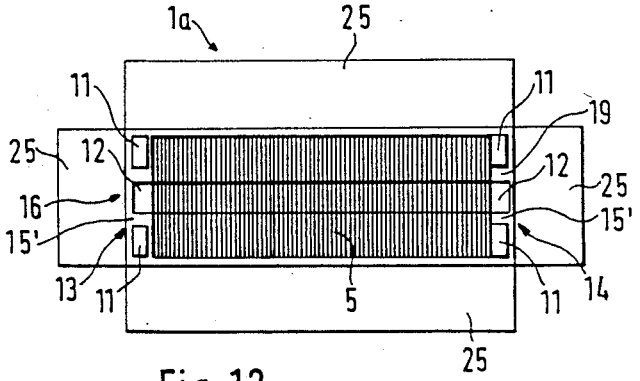
FIG. 12 is a plan view of a modified receptacle.

FIG. 12 shows a modified receptacle 1*a* which can be made of lightweight material, such as cardboard, and is provided with flaps 25 serving to overlie the open top of the receptacle 1*a* when the latter is in storage or in transit. Moreover, and in order to simplify the making of the receptacle 1*a*, its front and rear end walls 13 and 14 are devoid of recesses 15. Instead, the receptacle 1*a* is supplied with two pairs of inserts 11 which flank the respective end portions of the inlet 12 in the bottom wall 19 and are inwardly adjacent the end walls 13 and 14. This establishes recesses 15' between the pairs of inserts 11 adjacent the central portions 16 of the end walls 13, 14. The recesses 15' serve the same purpose as the recesses 15, i.e., the recess 15' in the front end wall 13 enables the member 3*a* of a holding device 3 and the left-hand prong 2*a* of a separating tool 2 to enter the receptacle 1*a* for the purpose of subdividing the supply 5 into a predetermined number of batches without permitting the partial supply to change its consistency (such as density and/or height) in response to repeated withdrawal of discrete batches. The inserts 11 can be made of laminated cardboard or any other suitable inexpensive material.

The inlet 12 in the bottom wall 19 of the receptacle 1*a* of FIG. 12 can serve the same purpose as the inlet 12 of a receptacle 1, i.e., it can permit introduction of the separating tool 2, of the holding device 3 and of the aligning device 10. Alternatively, the inlet 12 can serve solely as a means for permitting introduction of the member 3*a* of the holding device 3 and/or of the blades 10' of the aligning device 10 whereas the separating tool operates from above, i.e., it descends from a position above the open top of the receptacle 1*a* at the withdrawing station and lifts a fresly formed batch above the receptacle la preparatory to transfer into a vehicle or preparatory to delivery of the lifted batch all the way to the magazine 8 of a processing machine.

A portion of an apparatus wherein the separating tool 2' need not descend beneath the bottom wall 19 of the receptacle 1" at the withdrawing station P is shown in FIGS. 13*a* and 13*b*. Such separating tool 2' can be used with advantage to achieve a pronounced simplification of the apparatus (because the vehicle 7 of FIG. 1*b* can be omitted) as well as to avoid the need to move several receptacles at right angles to their longitudinal directions (note the arrow 301 in FIG. 11) if the apparatus is to deliver different types of bristles to a single processing machine B or to two or more discrete processing machines. The tool 2' and its carriage 107*a* are movable at right angles to the plane of FIGS. 13*a* and 13*b* by a motor of the corresponding transporting unit (not shown in FIGS. 13*a* and 13 *b*) so that the tool 2' can remove batches from the illustrated receptacle 1" as well as from a receptacle which is located in front of or behind the illustrated receptacle. This obviates the need for the platform 401 or for any other means for moving receptacles 1" in directions other than that indicated by the arrow 101.

The receptacle 1" differs from the receptacles 1 in that its bottom wall 19 need not be provided with an inlet 12 for the purpose of permitting entry of the tool 2' but solely for the purpose of permitting introduction of a holding device 3 and an aligning device 10 (such devices are not shown in FIGS. 13*a* and 13*b* because they can be identical with those shown in FIGS. 1*c* to 10). The supply 5 of bristles rests on two longitudinally extending inserts 28 which flank the inlet 12 and are preferably adjacent the respective sidewalls (only the sidewall 17 is shown in FIGS. 13*a* and 13*b*) so as to ensure that a recess or clearance 128 develops between the bottom wall 19 and the lowermost layer of bristles which constitute the supply 5 or a partial supply 5'. This is necessary in view of the design of the separating tool 2'.

An advantage of a separating tool 2' which is movable transversely of two or more receptacles (such as 1") at the withdrawing station P is that it is not necessary to provide each receptacle with a built-in holding device 3. Instead, the apparatus comprises a discrete holding device 3 for each of two or more foremost receptacles containing different types of bristles. The provision of a tool 2' which is movable transversely of the receptacles at the withdrawing station is particularly desirable and advantageous if the receptacles are bulky and heavy so that the provision of means for moving such receptacles in directions which are indicated in FIG. 11 by arrow 401 would contribute significantly to complexity as well as initial and maintenance cost of the apparatus.

The separating tool 2' comprises a straight first prong 26 which is fixedly secured to the carriage 107*a* and an L-shaped second prong 27 which is pivotable between the positions of FIGS. 13*a* and 13*b* by an electromagnet, a rack and pinion drive or any other suitable moving means 207*a*. The carriage 107*a* replaces the carriage 7*a* of FIG. 1*b* and the tool 2' replaces the vehicle 7, i.e., this tool forms part of the withdrawing unit as well as of the transporting unit. The construction of the vehicle 7 of the transporting unit T which is shown in FIG. 1*b* is or can be identical with the construction of the separating tool 2' of FIGS. 13*a* and 13*b*, i.e., the vehicle 7 can be opened to receive batches 6 from the tool 2 and is thereupon closed to transport a freshly received batch to the magazine 8 of a selected processing machine 8 prior to being opened again in order to deposit the batch into the adjacent magazine 8.

The prong 27 is moved to the open position of FIG. 13*a* before the carriage 107*a* is caused to lower the tool 2' toward and into the receptacle 1'' at the withdrawing station P. This enables the prong 27 to pass through the recess 15 in the front end wall 13 of the receptacle 1'' while the rigidly mounted prong 26 penetrates into the full supply 5 of bristles and separates therefrom a batch 6. The prong 27 is pivoted to the position of FIG. 13*b* as soon as its shorter lower part reaches the recess 128 between the two inserts 28. The batch 6 is then properly confined between the prongs 26, 27 and the carriage 107*a* lifts the tool 2*a* out of the receptacle 1'' while the holding device 3 (not shown) prevents the partial supply 5' from collapsing, i.e., from spreading out all the way to the front end wall 13 with attendant reduction of its height which would adversely affect the next-following batches. The apparatus of FIGS. 13*a* and 13*b* preferably also comprises an aligning device (not shown) which operates in the same way as described in connection with FIGS. 8 to 10. The holding and aligning devices can be introduced into the receptacle 1'' by way of the inlet 12 in its bottom wall 19.

It will be noted that the recess 15 in the front end wall 13 of the receptacle 1'' is deeper than the recess 15 in the rear end wall 14. The depth of the recess 15 in the front end wall 13 must suffice to permit entry of the prong 27 in fully open position. It is often preferred to provide the end wall 14 with a recess 15 which is as deep as the recess 15 in the end wall 13 because this renders it possible to advance (arrow 101) the receptacle 1' in the orientation which is shown in FIGS. 13*a* and 13*b* (i.e., with the end wall 13 leading) or in a second orientation with the end wall 14 taking the place of the end wall 13. The depth of the recess 15 in the end wall 14 must suffice to permit insertion of the rigidly mounted straight prong 26 of the separating tool 2'.

An important advantage of the apparatus which embodies the structure of FIGS. 13*a* and 13*b* is its simplicity. Thus, the separating tool 2' not only serves as a means for forming and raising batches 6 but also as a vehicle of the transporting unit so that it is not necessary to transfer each fresly formed batch from the separating tool into a discrete vehicle.

The apparatus which employs the separating tool 2' of FIGS. 13*a* and 13*b* can be used for evacuation of bristles from receptacles 1 of the type shown in FIGS. 1*c* to 11 as well as from receptacles 1*a* of the type shown in FIG. 12.

The strip- or bar-shaped inserts 28 of the receptacle 1'' can have a polygonal, semicircular or any other suitable cross-sectional outline. These inserts can be made of scraps of cardboard, wood or other suitable material. If the receptacle 1'' is devoid of an inlet 12 in the bottom wall 19, the holding device 3 and the aligning device 10 are designed to enter the receptacle 1' from above. All that is necessary is to install the moving means 103 and 110 of FIGS. 8 and 9 at a level above the withdrawing station P of FIGS. 13*a* and 13*b*. An advantage of a receptacle which does not have an inlet in the bottom wall and is devoid of recesses in its end walls is its strength, simplicity, low cost and compactness.

Figure 14:
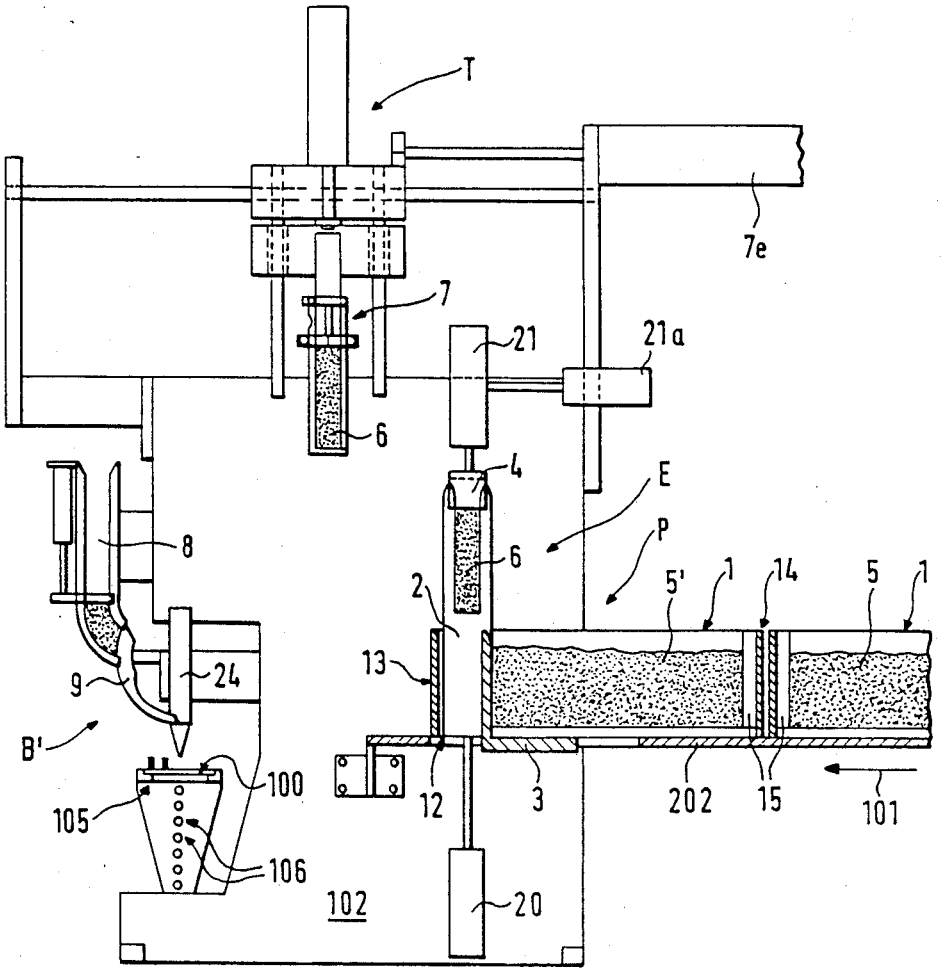
FIG. 14 is an elevational view of the brush making machine of FIG. 1*a* and a partly elevational and partly vertical sectional view of an apparatus constituting a slight modification of the apparatus of FIGS. 1*a* and 1*b*.

FIG. 14 shows an apparatus which is similar to the apparatus of FIGS. 1*b*–1*c* and a processing machine B' which is similar to those shown in FIG. 1*a*. The frame of this apparatus comprises an upright frame member or column 102 which carries the motor 20 for the separating tool 2, the machine B', the transporting unit T and all other parts of the withdrawing unit E. Such parts include a base plate 202 along which successive receptacles 1 can advance in the direction of arrow 101 toward the withdrawing station P. The tool 2 and the holding device 3 can enter the foremost receptacle 1 from below in the same way as described in connection with FIGS. 1*c*, 2 to 6 and 8 to 10.

The motor 21*a* which can move the motor 21 and the compacting device 4 relative to and with the separating tool 2 is mounted on the column 102. The vehicle 7 of the transporting unit T which is shown in FIG. 14 is identical with or analogous to the separating tool 2' of FIGS. 13*a* and 13*b*.

The body 100 of the brush which is being formed in the machine B' of FIG. 14 is supported by a work holder 105 in such a way that it can be tilted about the axis of any one of a battery of horizontal pivot members 106, depending upon the inclination of sockets for tufts of bristles in the body 100. The exact manner of inserting tufts of bristles into the sockets of the brush body 100 forms no part of the present invention. Such insertion is carried out by the tool 24 which receives tufts from the transfer element 9. The latter received bristles from the outlet of the magazine 8 of the processing machine B'.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of supplying bristles to at least one bristle processing machine, comprising the steps of establishing and maintaining at least one supply of loose substantially parallel bristles; mechanically separating from the supply successive batches of bristles, including repeatedly introducing a separating tool into the supply of bristles to thus separate successive batches from the supply; aligning the bristles in the supply at least in the regions of introduction of the tool; and transporting the separated batches to the at least one processing machine.

2. The method of claim 1, wherein said separating step further includes withdrawing from the supply batches of bristles at a predetermined location, and further comprising the step of moving the supply following each withdrawal of a batch so as to position fresh bristles at said location.

3. The method of claim 1, further comprising the step of maintaining the density of the supply of bristles at a substantially constant value.

4. The method of claim 1, further comprising the step of at least temporarily compacting the separated batches.

5. The method of claim 4, wherein said compacting step precedes said transporting step.

6. The method of claim 1, further comprising the steps of establishing and maintaining at least one additional supply of loose substantially parallel bristles, mechanically separating from the additional supply successive additional batches of bristles, and transporting the separated additional batches to the at least one processing machine.

7. The method of claim 6, wherein the additional supply contains bristles having characteristics different from those of bristles forming the at least one supply.

8. The method of claim 6, further comprising the step of carrying out the steps of transporting batches from said at least one supply and from said additional supply in accordance with a predetermined pattern.

9. The method of claim 6, wherein the step of transporting batches from the at least one supply includes transporting such batches to at least one first processing machine and said step of transporting additional batches includes transporting additional batches to at least one second processing machine.

10. The method of claim 1, wherein said aligning steps take place substantially simultaneously with the respective introducing steps.

11. The method of claim 1, wherein the quantity of bristles in the at least one supply is or approximates a whole multiple of the quantity of bristles in a batch.

12. The method of claim 1, wherein the bristles in the at least one supply and in the batches are substantially horizontal.

13. The method of claim 1, wherein said separating step further includes withdrawing successive batches from the at least one supply with the separating tool and said transporting step includes moving the separating tool with the withdrawn batch to the at least one processing machine.

14. The method of claim 1, wherein said separating step further includes withdrawing successive batches from the at least one supply with the separating tool and said transporting step includes conveying the batches in a vehicle, and further comprising the step of transferring successive withdrawn batches from the tool into the vehicle.

15. Apparatus for supplying bristles to at least one bristle processing machine, comprising at least one source of supply of loose substantially parallel bristles; means for withdrawing from the supply successive batches of bristles including a separating tool and means for moving said tool relative to said source so that the tool penetrates into the supply and separates therefrom batches of bristles whereby the tool establishes in the supply a gap between the separated batch and the remainder of the supply prior to withdrawal of the thus separated batch from the source; means for aligning the bristles in said source including at least one aligning element, means for moving the aligning element into the gap in the supply and means for moving the aligning element in the gap; and means for transporting the batches to the at least one machine.

16. The apparatus of claim 15, wherein the at least one processing machine comprises a magazine for batches of bristles, an inserting tool and means for transferring bristles from the magazine to said inserting tool, said transporting means including means for admitting batches into said magazine.

17. The apparatus of claim 15, wherein said tool includes prongs at least one of which is arranged to penetrate into the supply of bristles, said prongs defining a compartment for reception and withdrawal of a batch of bristles.

18. The apparatus of claim 15, wherein said source defines a chamber having a first length and said separating tool includes a batch-forming compartment having a second length, said first length being a whole multiple of said second length.

19. The apparatus of claim 15, wherein said source includes a plurality of receptacles for discrete supplies of bristles and each of said receptacles comprises built-in holding means, and further comprising means for moving selected receptacles of said plurality of receptacles to a predetermined position relative to said withdrawing means.

20. The apparatus of claim 15, wherein said element includes at least one blade extending transversely of the bristles in said source, said means for moving the aligning element in said gap including means for moving such element in parallelism with the bristles adjacent said gap.

21. The apparatus of claim 15, wherein said aligning means comprises two aligning elements which flank said tool.

22. The apparatus of claim 15, wherein said transporting means includes a vehicle movable along a predetermined path between a first position in which said vehicle receives batches from said withdrawing means and a second position at the processing machine.

23. The apparatus of claim 15, wherein said transporting means includes means for moving said tool between said source and the processing machine.

24. The apparatus of claim 15, wherein said source comprises a receptacle defining a chamber for the supply of bristles and being arranged to confine the bristles therein for the purposes of transport and storage.

25. The apparatus of claim 24, wherein said receptacle consists of a lightweight material.

26. The apparatus of claim 25, wherein the lightweight material is cardboard.

27. The apparatus of claim 24, wherein said receptacle is elongated and includes a bottom wall having a longitudinally extending inlet, said moving means including means for moving said tool into and from the receptacle by way of said inlet.

28. The apparatus of claim 27, wherein said inlet is an elongated slot in said bottom wall.

29. The apparatus of claim 24, wherein said receptacle includes two end walls and at least one insert adjacent at least one of said end walls, said insert and said one end wall defining at least one recess between the supply of bristles and said one end wall and said moving means including means for repeatedly moving said tool into and from said receptacle so that a first portion of said tool enters the receptacle by way of said at least one recess during initial entry of said tool into the receptacle and a second portion of the tool penetrates through the supply and separates a batch therefrom.

30. The apparatus of claim 15, wherein said source includes a receptacle having a bottom wall beneath the supply of bristles and distancing means including at least one insert between the bottom wall and the supply so that such insert defines a recess between the supply and the bottom wall, said moving means comprising means for moving said tool between a retracted position above said receptacle and an operative position in which the tool extends across the supply of bristles and to said recess and separates a batch of bristles from the supply.

31. The apparatus of claim 30, wherein said receptacle further comprises two sidewalls flanking said bottom wall and said distancing means includes an insert adjacent each of said sidewalls.

32. The apparatus of claim 30, wherein said bottom wall is devoid of openings.

33. Apparatus for supplying bristles to at least one bristle processing machine, comprising at least one source of supply of loose substantially parallel bristles, including a receptacle defining a chamber for said supply and having two end walls parallel to the bristles of said supply, at least one of said end walls having at least one recess; means for withdrawing from the supply successive batches of bristles, comprising a separating tool and means for moving said tool relative to said receptacle so that the tool repeatedly penetrates into and separates from the supply portions which constitute said successive batches, said tool including a portion which enters said at least one recess during initial penetration of the tool into said supply; and means for transporting the batches to the at least one machine.

34. Apparatus for supplying bristles to at least one bristle processing machine, comprising at least one source of supply of loose substantially parallel bristles; means for withdrawing from the supply successive batches of bristles, comprising a separating tool and means for moving said tool relative to said source from a retracted position at one side of said source to an operative position in which the tool extends into and separates a batch from the supply in said source; means for holding bristles in said source against movement relative to each other and relative to said source as a result of repeated withdrawal of batches from the supply, and means moving said holding means from a retracted position at said one side of the source to an operative position in the source; means for aligning the bristles in said source, including at least one aligning element and means for moving said element between a retracted position at said one side of the source and an operative position in the source; and means for transporting the batches to the at least one machine.

35. The apparatus of claim 34, wherein said source includes a receptacle having a bottom wall and an inlet for said tool and said holding means and said element in said bottom wall, said tool and said holding means and said element being outwardly adjacent said bottom wall in the retracted positions thereof.

* * * * *